United States Patent [19]

Mueller

[11] Patent Number: 4,937,544

[45] Date of Patent: Jun. 26, 1990

[54] "CONTACT ARRANGEMENT FOR A RELAY"

[75] Inventor: Erwin Mueller, Munich, Fed. Rep. of Germany

[73] Assignee: Siemens Aktiengesellschaft, Berlin and Munich, Fed. Rep. of Germany

[21] Appl. No.: 282,579

[22] Filed: Dec. 12, 1988

[30] Foreign Application Priority Data

Jan. 29, 1988 [DE] Fed. Rep. of Germany ..... 3802686

[51] Int. Cl.[5] ..... H01H 67/02

[52] U.S. Cl. ..... 335/128; 335/133; 335/83

[58] Field of Search ..... 335/78–89, 335/128, 124, 274, 270,

[56] References Cited

U.S. PATENT DOCUMENTS 4,267,540 5/1981 Iketani ..... 335/128
4,340,876 7/1982 Dammert et al. ..... 335/276
4,509,028 4/1989 Müler ..... 335/202
4,540,963 9/1985 Esterl et al. .

FOREIGN PATENT DOCUMENTS

83786/75 2/1977 Australia .
8235283 4/1983 Fed. Rep. of Germany .

*Primary Examiner*—Leo P. Picard
*Assistant Examiner*—Lincoln Donovan
*Attorney, Agent, or Firm*—Hill, Van Santen, Steadman & Simpson

[57] ABSTRACT

A contact arrangement has a contact spring which is prestressed against a seating edge of an actuation element by a prestress bend. The pre-stress bend lies at an angle of between 0 through 30 degrees relative to the seating edge so that roll-off is produced at the contact location. Such contact arrangement is especially advantageous for switching high-current loads since roll-off at the contact location reduces the welding tendency and makes an easier break-open of the contact when the contact is opening if there is a slight welding of the contacts.

15 Claims, 2 Drawing Sheets

"CONTACT ARRANGEMENT FOR A RELAY"

BACKGROUND OF THE INVENTION

1. Field of the Invention

The present invention is directed generally to a contact arrangement for a relay including an improved contact spring. In particular, a contact spring in a relay has a spring leg having one end secured and a free end with a contact piece pressing against a cooperating contact element in the closed position of the contact and is lifted off from the cooperating contact element in the open condition of the contact by an actuation element.

2. Description of the Related Art

There are a great number of relays having contact arrangements similar to that described above. For example, a German utility model No. 82 35 283 discloses such a relay in which the contact spring is pre-stressed by means of a pre-stress bend extending transversely relative to a longitudinal direction of the spring leg. Relays of this type have a simple structure where the contact spring is frequently directly joined to the armature or actuation element. Such relays are often utilized for switching high DC loads; for example, one application provides a relay of this type for switching lamp circuits in motor vehicles where peak currents can reach 180 amperes. Such high switching loads lead to the formation of arcs which can frequently cause welding of the contacts and, thus, failure of the relay. This is particularly true when the relays undergo turn-on chattering. To prevent such premature breakdown of the relay, however, it is necessary to achieve high break-open forces so that contacts which are slightly welded together can be opened again and the relay remains functional. It is known to provide high-power springs as the contact spring for resetting the contact for this purpose. This, of course, requires a corresponding increase in the attractive force and in the response excitation power for the relay. It is also advantageous to provide a great over-lift or over-travel of the armature when the armature is closing the contact. Due to such increased excitation power, however, the pre-stress or the increased restoring force cannot be selected arbitrarily high.

SUMMARY OF THE INVENTION

It is an object of the present invention to reduce chattering tendency as one cause of contact welding when closing contacts in a relay as well as to facilitate break-open of welded relay contacts during opening.

This and other objects are inventively achieved by providing at least one pre-stress bend in the contact spring lying at an acute angle relative to a seating edge of the actuation element for the spring leg.

Such pre-stress bend, which proceeds obliquely relative to the seating edge or actuation edge, enables the spring to undergo a torsional motion both when closing as well as when opening the contact so that a lateral roll-off from the contact location is caused. As a result thereof, the impact energy in closing the contact is partly converted into friction, which leads to a reduction in the chattering tendency. Due to the oblique pre-stress bend, moreover, the actuation element also attacks asymmetrically on the contact spring when opening the contact as well. This creates additional torsion forces that act on possibly welded contact location and facilitates break-open thereof.

When the actuation element is an armature on which the contact spring directly rests, the contact spring is supported at an edge of the armature in the region between the obliquely proceeding pre-stress bend and the contact location. However, it is also conceivable to apply such an obliquely proceeding pre-stress bend in some other relay structure as well, in which case the edge of an actuation or supporting element replaces the armature edge. One possibility is to provide an angled pre-stress bend in a stationary contact part rather than in the movable contact part. Such angled bend will still cause torsional motion of the contacts during opening and closing.

To achieve the greatest possible over-lift, a single pre-stress bend can also be replaced by two or more such bends. These multiple pre-stress bends can proceed parallel to one another or at an angle relative to one another as well. Since a moment of force must be present for a torque to occur in the spring, if there are two pre-stress bends it is possible to provide one bend parallel to the seating edge of the actuation element and to provide a second bend obliquely angled relative thereto. However, when two pre-stress bends are provided, both bends can be at an angle either in the same direction or angled in opposite directions to one another.

The angle between the pre-stress bend and the seating edge of the actuation element preferably amounts to between 0 and 30 degrees. Good results have been achieved when an angle on the order of magnitude of 5 degrees is used.

The distance of the bend, or of the multiple bends, from the clamping or fastening location is dependent on the geometry of the spring and on the desired angle of incidence against the cooperating contact. What is more important is the size of the wobble or rolling motion of the contact which derives from the deflection and the torque of the spring. A relatively great overlift should, therefore, be provided when closing the contacts.

The pre-stress force with which the spring is pre-stressed relative to the actuation element, for example, should amount to approximately 20 through 30 percent of the contact force. When a cooperating contact spring is pre-stressed against the supporting plate, this percentage is usually higher.

DESCRIPTION OF THE PREFERRED EMBODIMENTS

Figure 1:
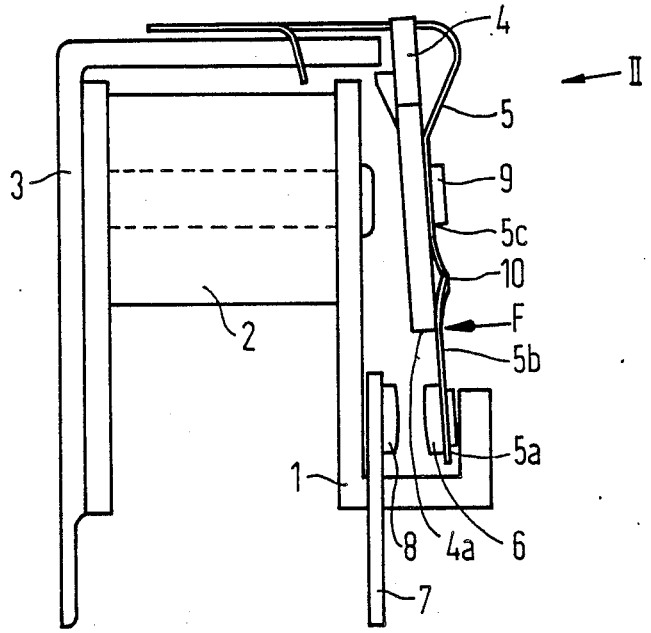
FIG. 1 is a side elevational schematic illustration of a relay system having a contact spring secured to and supported against an armature in accordance with the principles of the present invention.
Figure 2:
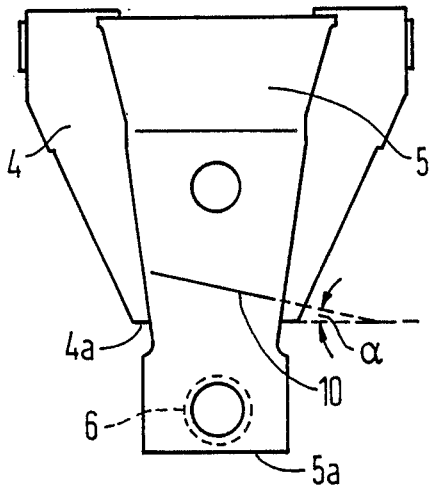
FIG. 2 is an end view of the armature and contact spring of FIG. 1 in the direction of arrow II.

In FIG. 1, a relay system is shown schematically including a coil member 1, a winding 2, a yoke 3, and a flat armature 4 which is seated on the yoke 3. A contact spring 5 is connected to the armature 4. This contact spring 5 carries a contact piece 6 at its free end 5*a*. The contact piece 6 cooperates with a cooperating contact element 7 which is anchored in the coil member 1, the cooperating contact element 7 having a contact piece 8 which is contacted by the contact piece 6.

The contact spring 5 is pre-stressed toward the armature 4 and thus toward the cooperating contact element 7 in the region between a fastening location 9 to the armature 4 and the free end 5a. This pre-stress is generated by an obliquely proceeding pre-stress bend 10 which produces a defined seating force F at an armature edge 4a. The angle $\alpha$ between the seating edge 4a and the pre-stress bend 10 may amount to between 0 and 30 degrees and preferably lies in a range of between 5 and 10 degrees.

Due to the pre-stress bend 10, the contact piece 6 rolls off the contact piece 8 when closing and when opening the contact. This leads to reduction in the chattering of the contact pieces 6 and 8 and an easier break-open of the contact if a slight welding therebetween has occurred, such as in a high current application. Less force is required to break a weld using a rolling or torsional motion than if a relatively straight pull is exerted.

Figure 3:
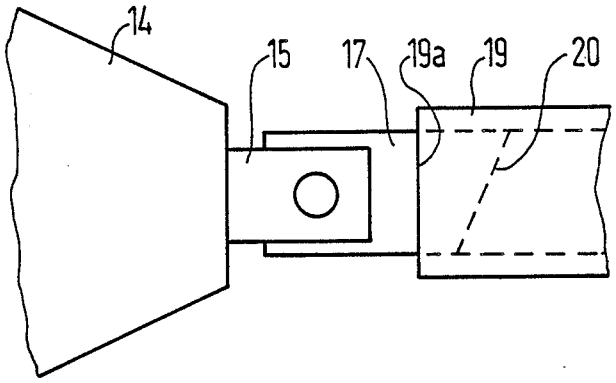
FIG. 3 is an enlarged fragmentary view of a contact arrangement according to the invention which has a cooperating contact spring with an obliquely proceeding bend.
Figure 4:
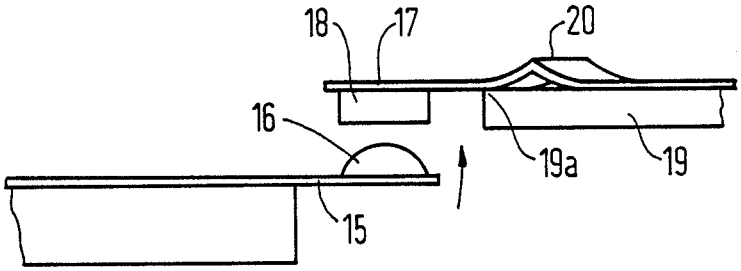
FIG. 4 is a side elevational view of the contact arrangement of FIG. 3.

Referring to FIGS. 3 and 4, a further embodiment of the invention includes a contact arrangement for a relay wherein the relay system is not shown. In the second embodiment, an armature 14 (only part of which is shown) is coupled to a moveable contact spring 15 which is directly connected thereto. It is also possible that the moveable contact spring 15 can be actuated by some intermediate element rather than the armature 14. A contact piece 16 on the contact spring 15 cooperates with a contact piece 18 on a cooperating contact spring 17. The moveable contact spring 15 may be more or less rigidly connected to the armature 14 since it does not require any great elasticity. In this case, too, the cooperating contact spring 17 is also elastic so as to absorb the over-travel of the armature 14 when the contact is closed.

The cooperating contact spring 17 is pre-stressed relative to a supporting plate 19 by an obliquely proceeding pre-stressed bend 20 so that the spring 17 presses against an edge 19a of the supporting plate 19 in the quiescent condition. The affect of the oblique pre-stressed bend 20 is the same as in the example set forth above, as is the advantages realized thereby. The pre-stress force, however, is higher in this case and lies nearly at the level of the contact force. Likewise, all possible embodiments of the previous example are also valid for the example shown in FIGS. 3 and 4. In other words, the improvement of the present invention may be applied to contacts of various types of relays. It is also possible to utilize the teachings of the present invention in other contact arrangements no necessarily found in relays.

Although other modifications and changes may be suggested by those skilled in the art, it is the intention of the inventor to embody within the patent warranted hereon all changes and modifications as reasonably and properly come within the scope of his contribution to the art.

I claim:

1. A contact arrangement for a relay having an actuation winding, comprising:
   - a contact spring having a spring leg with a secured portion and a free end;
   - a first contact piece on said free end of said spring leg;
   - an actuating element having a seating edge attacking said contact spring between said secured portion and said free end;
   - a cooperating contact piece against which said first contact piece rests when in a closed position and from which said first contact piece is lifted when being moved to an open position;
   - said first contact piece being moved between said closed position and said open position by actuation of said actuating element; and
   - at least one angled pre-stress bend in said contact spring proceeding at an acute angle relative to said seating edge of said actuating element.

2. A contact arrangement as claimed in claim 1, wherein said actuation element attacks said contact spring between said at least one angled pre-stress bend and said first contact piece.

3. A contact arrangement as claimed in claim 2, wherein said actuation element is an armature to which said contact spring is secured, said contact spring having a portion being supported on said seating edge of said armature when in said open condition.

4. A contact arrangement as claimed in claim 1, wherein said pre-stress bend lies at an angle of between 0 and 30 degrees relative to said seating edge of said actuation element.

5. A contact arrangement as claimed in claim 4, wherein said pre-stress bend proceeds at an angle of approximately 5 degrees relative to said seating edge of said actuating element.

6. A contact arrangement as claimed in claim 1, wherein said at least one angled pre-stress bend is a plurality of pre-stress bends.

7. A contact arrangement as claimed in claim 6, wherein said plurality of pre-stress bends all proceed in the same direction relative to said seating edge.

8. A contact arrangement as claimed in claim 6, wherein said plurality of pre-stress bends proceed in opposite directions relative to said seating edge.

9. A contact arrangement, comprising:
   - a first contact spring;
   - a first contact piece at a free end of said first contact spring;
   - a second contact;
   - a second contact piece resting against said first contact piece when in a closed condition and from which said first contact piece is lifted when being moved to an open position;
   - means for moving said first and second contact pieces relative to one another between said closed position and said open position; and
   - a pre-stress bend in said first contact spring at an oblique angle relative to a longitudinal direction thereof.

10. A contact arrangement as claimed in claim 9, further comprising:
   - a supporting plate having a seating edge, said first contact spring which has said angled pre-stress bend being secured to said supporting plate so that said seating edge presses against said one contact spring between said pre-stress bend and said free end.

11. A contact arrangement as claimed in claim 9, wherein said pre-stress bend is at an angle of between 0 and 30 degrees relative to said seating edge.

12. A contact arrangement as claimed in claim 11, wherein said angle of said pre-stress bend relative to said seating edge is between approximately 5 and 10 degrees.

13. A contact arrangement as claimed in claim 10, wherein said supporting plate is an armature of a relay.

14. A contact arrangement as claimed in claim 9, wherein said first contact spring is a stationary contact spring of a relay.

15. A contact arrangement as claimed in claim 9, wherein said first contact spring is a movable contact spring of a relay.

* * * * *